United States Patent [19]

Holdt

[11] Patent Number: 4,795,214

[45] Date of Patent: Jan. 3, 1989

[54] CONVERTIBLE WHEELCHAIR/LITTER

[75] Inventor: Donald H. Holdt, Cambridge, Md.

[73] Assignee: Cambridge Technologies, Inc., Cambridge, Md.

[21] Appl. No.: 685,710

[22] Filed: Aug. 17, 1987

Related U.S. Application Data

[60] Continuation-in-part of Ser. No. 673,850, Nov. 21, 1984, Pat. No. 4,632,450, and Ser. No. 886,008, Jul. 16, 1986, which is a division of Ser. No. 673,850.

[51] Int. Cl.[4] ..... A47C 1/02; A44C 7/00

[52] U.S. Cl. ..... 297/443; 4/237; 297/84; 297/193; 297/440; 297/DIG. 4

[58] Field of Search ..... 297/443, 440, DIG. 4, 297/192, 193, 84; 4/485, 486, 234, 237

[56] References Cited

U.S. PATENT DOCUMENTS

| | | | |
|---|---|---|---|
| 601,312 | 3/1898 | Beall | 297/193 X |
| 1,657,285 | 1/1928 | Siskin | 297/444 |
| 2,669,295 | 2/1954 | Shepherdson | 297/440 |
| 2,694,437 | 11/1954 | Glaser | 5/81 R |
| 2,912,702 | 11/1959 | Mackenzie | 297/193 X |
| 2,913,732 | 11/1959 | Jones | 297/192 X |
| 3,769,638 | 11/1973 | Clanan | 4/237 |
| 3,858,938 | 1/1975 | Kristensson | 297/433 |
| 3,936,893 | 2/1976 | Anderson | 5/81 R |
| 4,032,191 | 6/1977 | Fetsch | 297/444 |
| 4,155,126 | 5/1979 | Classen | 297/440 X |
| 4,193,147 | 3/1980 | Fischer | 5/81 R |
| 4,365,840 | 12/1982 | Kehl | 297/444 |
| 4,564,238 | 1/1986 | Wolpert, Jr. | 297/440 |

OTHER PUBLICATIONS

American Hospital Supply Catalog, pp. F-5 and F-6.

*Primary Examiner*—James T. McCall

*Attorney, Agent, or Firm*—Roylance, Abrams, Berdo & Goodman

[57] ABSTRACT

An invalid wheelchair/litter having improvements in the areas of a cushioning cylinder that softens the lowering motion from the litter configuration to the chair configuration to protect the patient, providing removable upholstery which permits use of slip covers and quick and easy cleaning of the apparatus, improved foot rest structure having numerous advantageous features, and a toilet seat variation to permit the user to perform bodily functions while seated in the invention apparatus.

9 Claims, 7 Drawing Sheets

FIG. 6
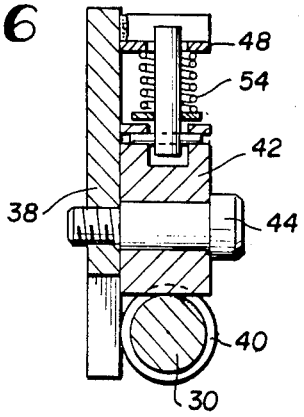
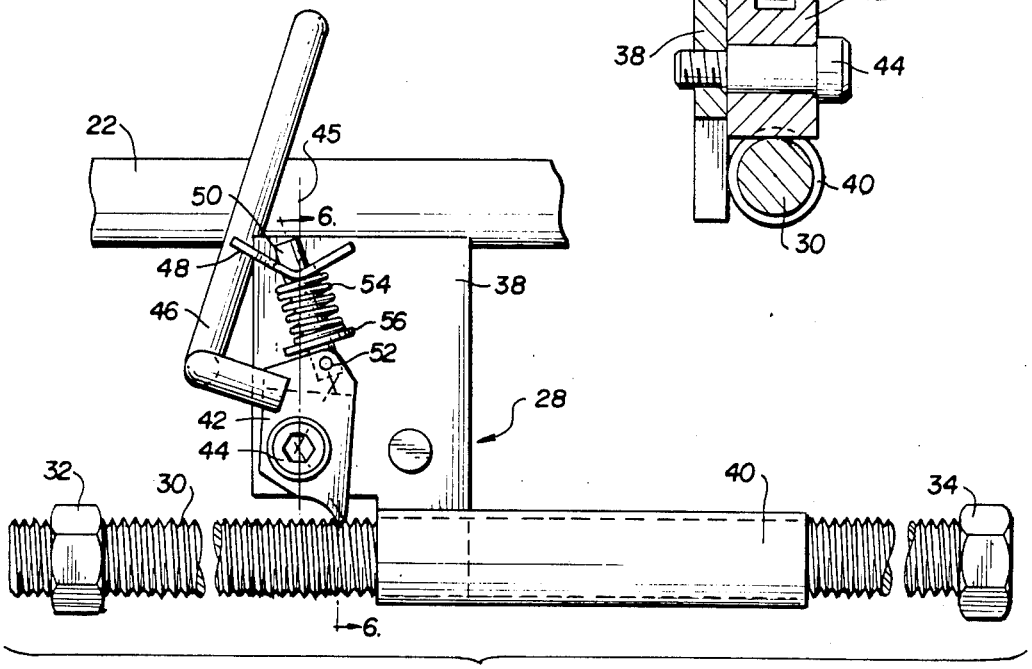
FIG. 5
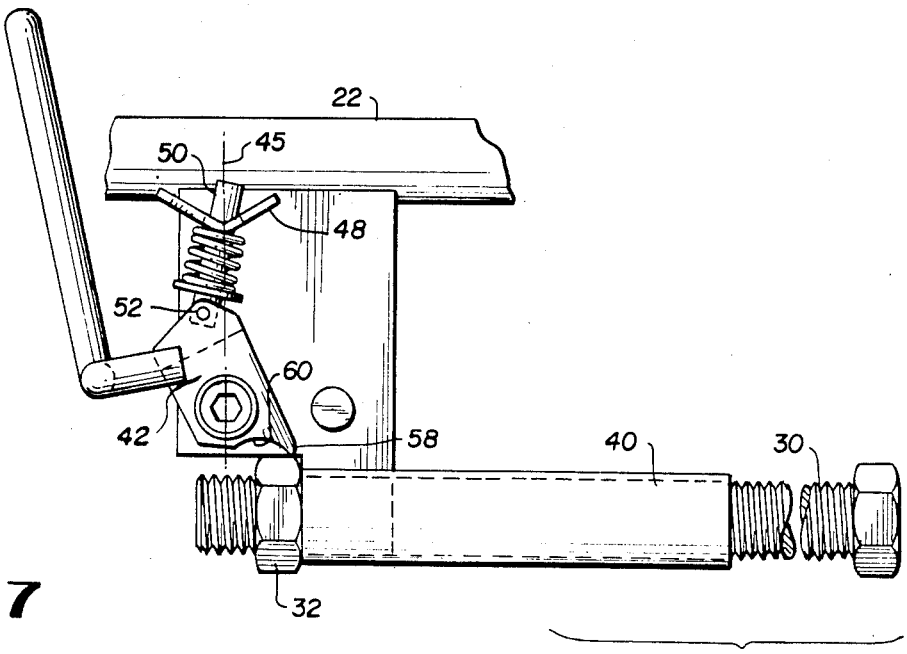
FIG. 7

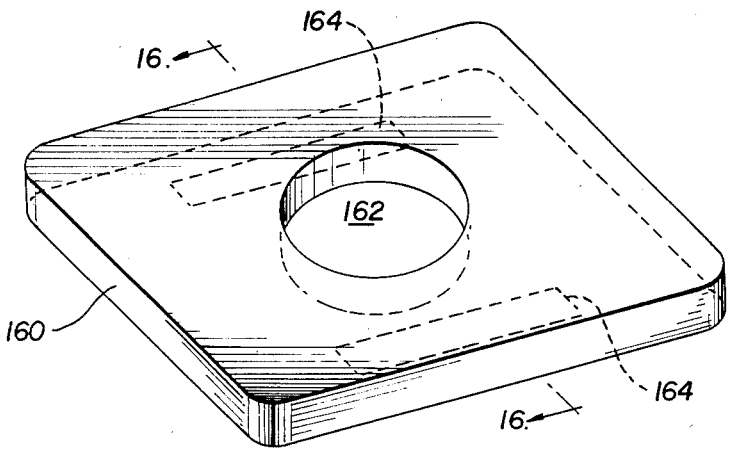
FIG.15
FIG.16
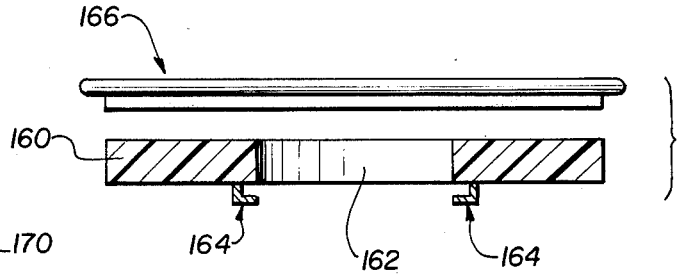
FIG.17
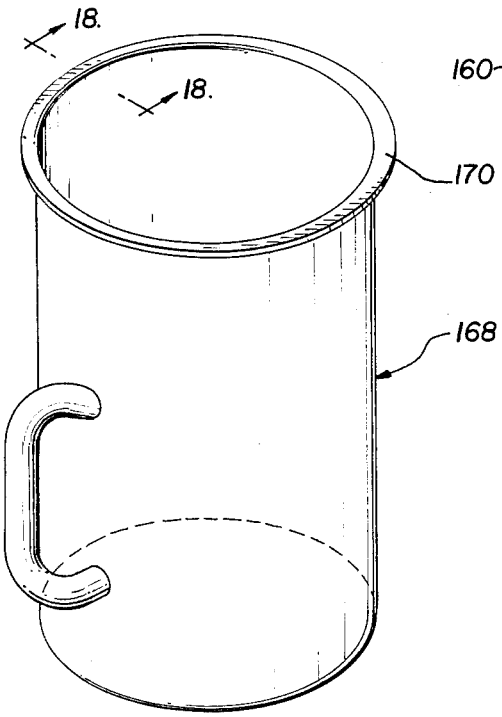
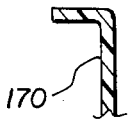
FIG.18

CONVERTIBLE WHEELCHAIR/LITTER

REFERENCE TO RELATED APPLICATIONS

This application is a continuation-in-part of my two prior patent applications Ser. No. 673,850 filed Nov. 21, 1984 entitled "Convertible Wheelchair/Litter" now issued as U.S. Pat. No. 4,632,450; and its divisional application Ser. No. 886,008 filed July 16, 1986 entitled "Removable Upholstery for Wheelchairs and the Like" copending herewith, both of which are commonly owned with the present invention, and the entire disclosures of both of which are hereby incorporated by reference as if here set forth in full.

FIELD OF INVENTION

This invention relates to apparatus for use by geriatric, seriously ill, invalid, and the like persons, wherein there is a need for a single piece of apparatus in which the patient can sit, and upon which the patient can lie. Further, it is necessary that it be possible to move the patient about while in the apparatus. That is, the invention serves the function of both a hospital litter and a wheelchair. Further, the invention provides means so that the user can perform bodily functions while seated in the apparatus.

PROBLEMS IN THE PRIOR ART

The present invention is a substantial step forward in this art in that it provides an improved convertible chair/litter of the character described which will permit several advantageous features in use.

An important area of use has to do with emergency situations. That is, assuming the patient is using the apparatus in the wheelchair configuration, and an emergency such as a heart attack or the like should arise, it then becomes necessary to rapidly move the patient from the chair to the litter position. This presents numerous problems in the prior art.

One such area has to do with the foot rests. It has been long known in this art to provide independently operable foot rests in order to accommodate a patient having a need to have one leg higher than the other, i.e., gout, broken bone in that leg limb, or the like. When it becomes necessary to rapidly change the configuration of the apparatus from chair to litter, independently operated foot rests could cause a delay. That is, it might be necessary for attending personnel to take valuable, possibly life-endangering time, to make adjustments or changes in the foot rests left and right independently, before being able to move from the chair to litter configuration. This problem is overcome by the invention apparatus as set forth below.

Another area has to do with permitting relatively rapid motion from chair to litter for emergency purposes, while at the same time providing means to comfortably cushion the reverse motion from litter to chair so as to ease the work of the attendant while at the same time assuring that the apparatus will not rapidly go into the chair configuration as it naturally tends to do due to the weight of the patient. That is, the structural arrangement is such that when in the litter configuration certain parts of the apparatus, primarily the seat, carrying the bulk of the weight of the patient are at a higher level than they are in the chair configuration. If these cushioning means were not provided, it is possible that an unduly rapid motion of the apparatus could result, which unduly rapid motion could result in severe upsetting of the patient, and even throwing of the patient out of the apparatus. Preventing this, in the prior art, required the operator to use his strength to hold back against the weight to gently move the patient. The cushioning arrangement of the invention thus saves effort by the operator or attendant, while assuring no such potentially dangerous operation in the motion into the chair configuration.

At the same time, this cushioning is such that the desired rapid emergency motion can be achieved, that is, motion from chair to litter configuration.

Yet another area has to do with cleanliness of apparatuses of this sort. When dealing with geriatric or incontinent patients, there is a severe problem concerning food, vomit, body wastes, and the like getting on the apparatus. These waste materials must be removed from the chair in order to not create a health hazard. In some medical situations it is necessary to frequently do such cleaning. This aspect of the invention is applicable to other types of seating equipment, such as conventional chairs and wheel chairs, geriatric chairs, aircraft seats, and the like.

The present invention provides improved means to permit this cleaning, while also providing other advantages as to hygiene, all as set forth below.

Using prior art equipment of the same general type of the present invention, it was necessary to lift or otherwise move the geriatric or seriously ill person from the apparatus to a toilet or the like in order to permit the patient to perform his or her bodily functions. This is a serious problem, the patients can be exceedingly frail, exceedingly heavy, or it may be a problem for various other reasons to have to move the patient. The present invention provides relatively simple means to permit the patient to perform such bodily functions while seated in the invention apparatus, as set forth below.

SUMMARY OF THE INVENTION

The present invention provides a convertible wheelchair/litter of the character described which solves all of the above problems, and which provides yet further advantages over the prior art in general.

In the area of the foot rests, each foot rest is provided with a ratchet type adjusting arrangement based on a relatively fine screw thread. A pawl cooperates with this thread to permit a great range of different adjustments. That is, each turn of the screw thread on the rod cooperating with the pawl corresponds to a separate adjusted position.

In the motion from chair to litter with the two foot rests at different adjusted positions, means are provided cooperable with the foot rests to lift the pawls off of the respective screw threads to permit the two foot rests to also go into the litter configuration. Absolutely no adjustment or attention need by paid by the attendant or the operator to the foot rests during this emergency move. This is an extremely important advantage of the invention, since, as when dealing with heart attacks or the like, seconds can make the difference between life and death.

Further as to the foot rests, when it is again necessary to return this particular patient while still on the apparatus back to the chair configuration from the litter configuration, the foot rests will go back to vertical. Each foot rest includes an over-center latch arrangement which is automatically switched into release when that foot rest is moved up into litter configuration. Thereafter, when the device is moved back to the chair position the foot rests will automatically go all the way down to the vertical, normal seating position since the ratchet was automatically released in litter position.

As to the cushioning means, the invention in this area comprises a cylinder which may be pneumatic or hydraulic, and which includes a relief area on the piston rod, and a slidable piston mounted on the rod and spring loaded to one position with respect to the relief area. The arrangement of parts is such that in one position the spring loaded piston will block the relief slot on the piston rod, thus assuring the full dampening effect of the cylinder overall on the motion of the apparatus from the litter to the chair configuration. When the apparatus is moved in the opposite direction, from chair to litter which would occur in the event of an emergency, in that case the piston is urged to open up the relief slot, thus allowing the working fluid, air or oil, to bypass the piston to a substantial extent, thus providing virtually no dampening action on the motion of the apparatus in this direction, i.e., from chair to litter. No dampening is required by the attendant, since in this direction, moving the invention apparatus with the patient therein from chair to litter, the attendant must expend energy to in effect raise the weight of the patient against gravity.

As to one of the hygiene aspects, the present invention provides means to permit quick removal of the seat cushion and the back cushion from the apparatus. The remainder of the apparatus other than these two major upholstered portions is made of stainless steel, chrome plated steel, and other materials which can withstand water. Thus, if the patient has soiled the apparatus, the two major upholstered pieces are quickly and easily removed, permitting their separate cleaning away from the apparatus, and permitting cleaning of the remainder of the apparatus, the metal framework and other parts, by, if desired, simply hosing down that major apparatus.

Other advantages flowing from the quick removal of the seat and back include that the upholstery can be easily repaired in the event it is damaged or worn, the upholstery can be easily changed, no crevices, folds and the like in the upholstered parts of the apparatus are created, and this quickly removable upholstery lends itself to use with covers. That is, if a hospital has such an apparatus and will sometimes use it with a patient who will not soil the apparatus and sometimes use it with a patient likely to soil the chair/litter, then for the second patient the hospital could put a disposable cover on the upholstery which in the event of need can be simply removed, discarded and replaced for later use with other such patients. The ordinary upholstery could be used for normal patients without any such cover. This is a virtually unheard of advantage in hospital equipment of the character of the present invention, and in use on other types of seating equipment with which this aspect of the invention can be used.

The present invention provides an improved seat having a hole in it to permit the passage of body wastes from the patient into a catch bucket which is removably mounted at the underside of the seat. The seat is provided with a hole for the passage of these materials, and the catch bucket is positioned by other means under the hole. A removable cushion seat may be provided over the hole on the top side in order to permit normal usage of the seat, or the entire toilet seat can be removed and replaced by the regular upholstered seat.

Overall then, it can be seen that the present invention provides a convertible chair/litter for the environments described above which is a substantial step forward in this art, solves several long standing problems in the prior art, provides many heretofore unknown advantages in this type of apparatus, and which is yet simply and reliable in operation, and strong, practical, durable, and highly suited to its use.

BRIEF DESCRIPTION OF THE DRAWINGS

The invention will be best understood from a careful and detailed reading of this disclosure including the drawings forming a part wherein:

FIG. 5 is a detailed showing of the foot rests operating mechanism;

FIG. 6 is a cross-sectional view taken on line 6—6 of FIG. 5;

FIG. 7 is a view similar to FIG. 5 showing the automatic unlocking action of the foot rests;

FIG. 15 is a view analogous to FIGS. 12 and 14 showing a top view of the improved toilet seat embodiment of the invention;

FIG. 16 is a partial cross-sectional view taken on line 16—16 of FIG. 15 and in addition illustrating the use of an optional cover for the toilet seat embodiment;

FIG. 17 is a perspective view of the catch bucket for use with the toilet seat of FIGS. 15 and 16; and FIG. 18 is a partial cross-sectional view taken on line 18—18 of FIG. 17 showing the lip of the catch bucket of FIG. 17 for cooperation with the rails of the toilet seat of FIG. 15.

DETAILED DESCRIPTION OF THE PREFERRED EMBODIMENT

Figure 1:
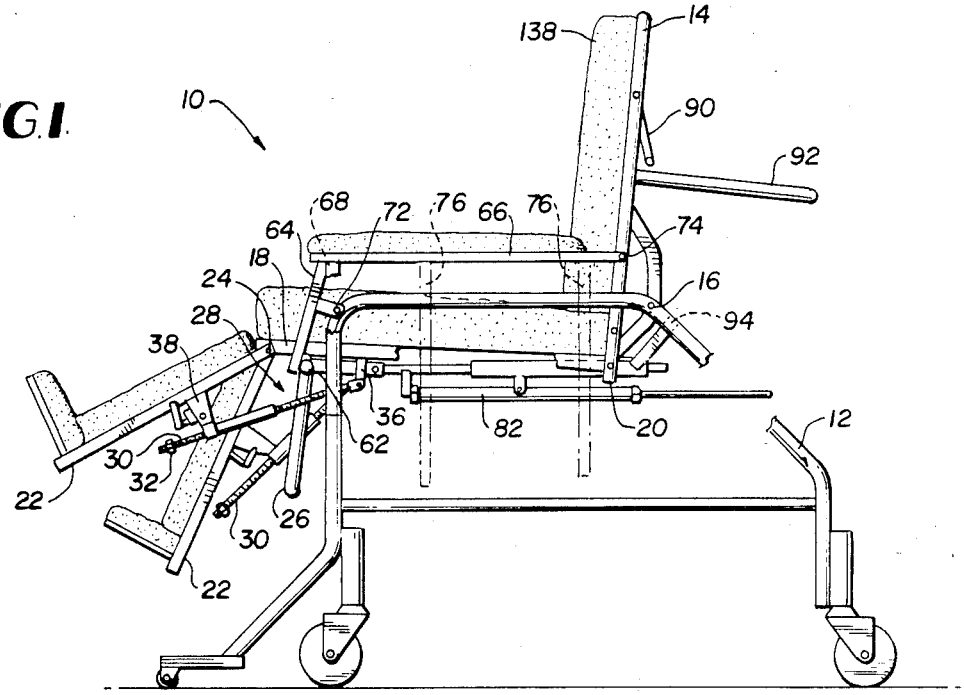
FIG. 1 is a side elevational view with some parts broken away, some parts shown in dotted lines, and some parts omitted for the sake of clarity, showing a preferred embodiment of a convertible wheelchair/litter according to the invention.

FIG. 1 shows a convertible wheelchair/litter in accordance with the invention. The device is built about a framework 12 having wheels and means to mount all of the other portions, the framework itself not forming a material part of the present invention except as support for the various other parts described below.

Figure 10:
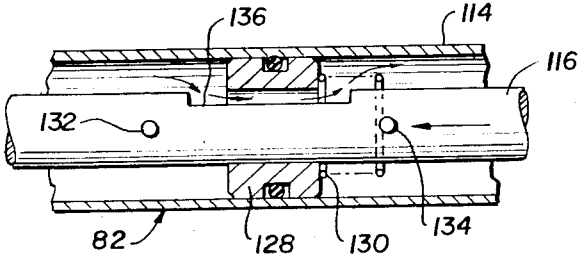
FIG. 10 is a view similar to part of FIG. 9 showing another position of the piston in the cushioning cylinder.
Figure 11:
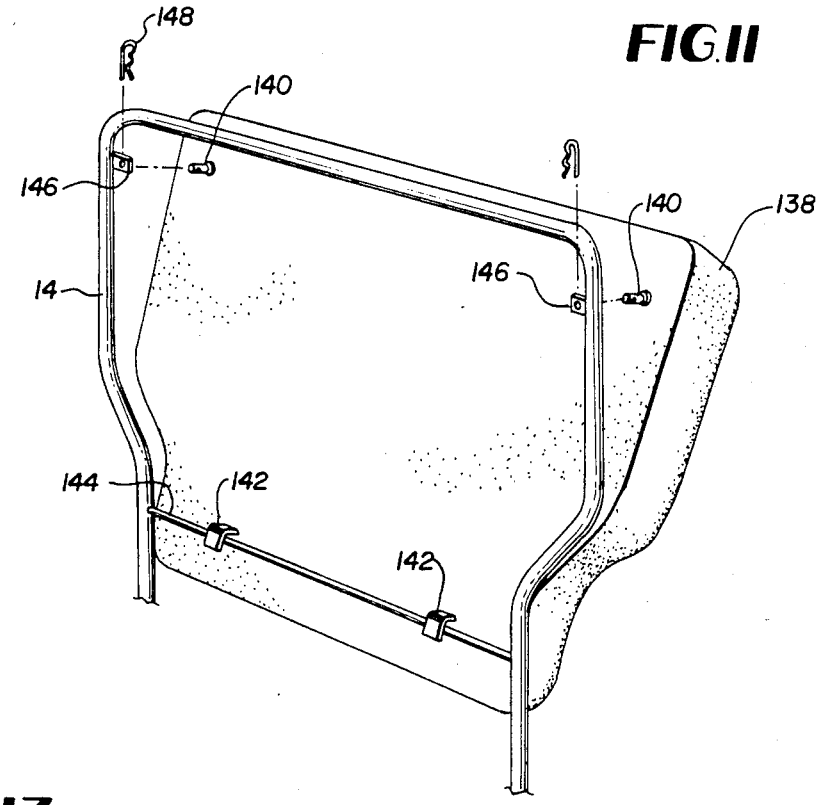
FIG. 11 is an exploded view showing the manner of mounting the back rest of the device of FIG. 1.

A back rest framework 14, see also FIG. 10, is pivotally mounted to the frame 12 at pivots 16. A pair of seat frame members 18 are pivoted at their rear ends to the bottom of the back rest framework 14 at pivot points 20, which can be in the form of cross bars, see FIG. 14. Left and right foot rests 22 are pivoted at their upper ends to their respective left and right seat frame member 18. The foot rests 22 are symmetrical but otherwise identical to each other.

Figure 2:
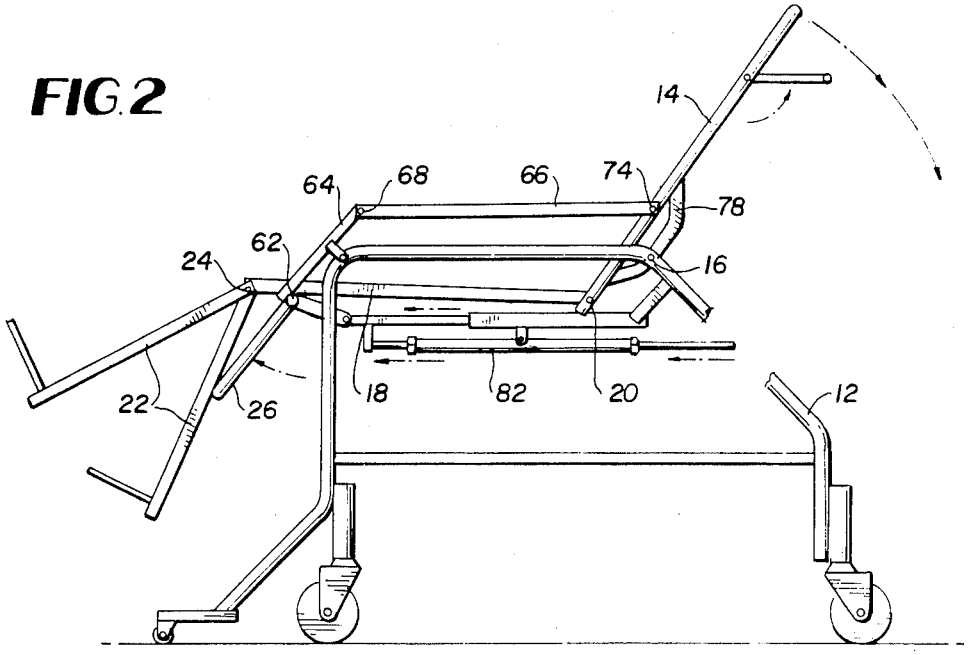
FIGS. 2, 3, and 4 a of drawings showing the wheelchair/litter of FIG. 1 with additional parts removed, and showing the operation moving from the chair position of FIG. 1 to the litter position of FIG. 4.
Figure 3:
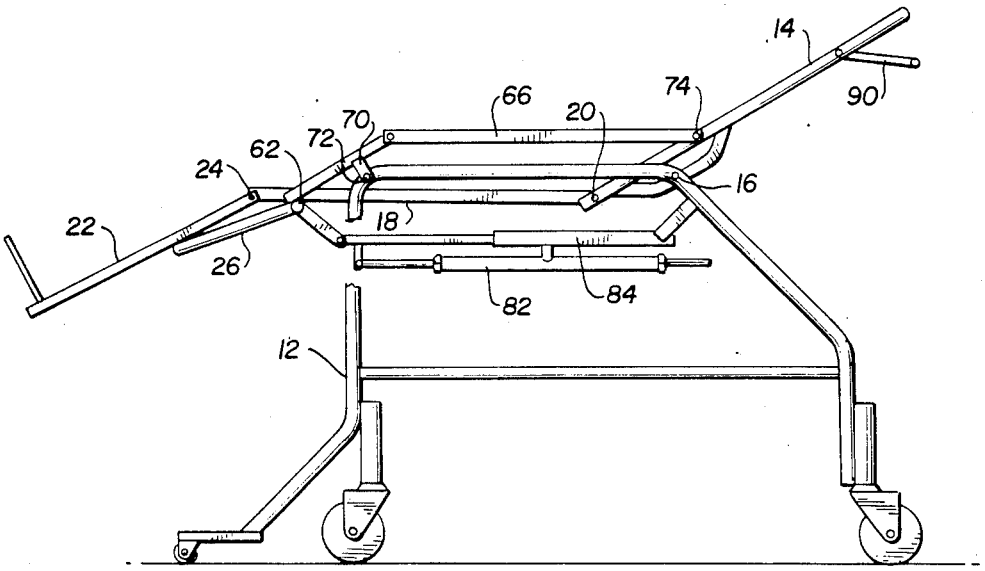
Figure 4:
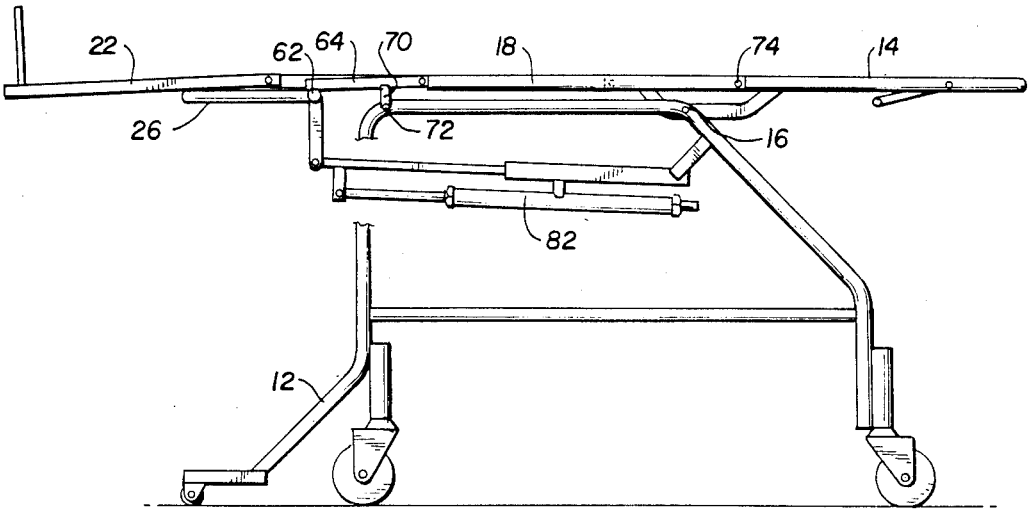

Means are provided to lift the foot rests 22 when moving from the chair configuration of FIG. 1 into the litter configuration of FIG. 4, and to thereafter permit the foot rests to return to the normal vertical unadjusted position when the chair is again moved back from the litter to the chair configuration. To this end there is provided a foot rest lifting bar 26 which is connected to and operated by the guide cylinder and cushioning cylinder arrangement by means and in a manner described below. This bar 26 is caused to swing upwardly and to the left as shown in the drawings to progressively move both foot rests together up to the litter position. The action is depicted by the sequence of FIGS. 2, 3 and 4.

Cooperating with the lifting action of the foot rest lift bar 26, the foot rests 22 themselves are mounted to the seat frame 18 by way of a foot rest adjusting assembly 28, best seen in FIGS. 1 and 4–7. Each assembly 28 includes an elongated adjusting screw 30, having an adjusting nut or stop member 32 at one end and a securing nut 34 at the opposite end which fixes that end of the adjusting screw 30 to a bracket 36 fixed to the underside of the seat 18.

Means to guide each foot rest's motion on the individual screws 30 and to adjust the position of the foot rests with respect to the seat are provided. These means comprise a bracket 38 to which the other parts are mounted, including a guide sleeve 40 at the lower end of the bracket 38. This sleeve 40 as shown in FIG. 5 snugly but slidingly receives the adjusting screw 30.

Bracket 40 carries a pawl 42 pivotally mounted to the bracket at a pivot 44. Pawl 42 carries a manual operating lever 46 to permit the operator to change the position of the pawl.

FIG. 5 shows arbitrary adjusted positions of the foot rests 22, for example, the position of the left-hand foot rest in FIG. 1. FIG. 7 shows the position of the foot rests apparatus in the litter position of the invention device as shown in FIG. 4. Means are provided to hold the pawl 42 in either the adjusted position of FIG. 5 or the release position of FIG. 7, whichever position the pawl is in. These means comprise an over-center spring arrangement, the operation of which can be easily seen by reference to the imaginary line 45 shown in FIGS. 5 and 7.

This over-center spring arrangement comprises an upper bracket 48 which is welded or otherwise secured to the side of the bracket 38. An over-center pin fits in a snug opening in the bracket 48 at one end, and has its other end pivoted as at 52 to the upper end of the pawl 42. A spring arrangement 54 is constrained between the bracket 48 and a stop shoulder 56 on the pin 50 to strongly urge the pawl to the over-center position to the right of line 45 in FIG. 5 or the other over-center position to the left of line 46 as shown in FIG. 7. The pawl tooth 58 at the lower end of the pawl 42 is defined by a cutout 60.

The operation of this structure is that the nut 32, as the apparatus moves from the sitting position of FIG. 5 to the litter position of FIG. 7 strikes against the cutout 60, thus throwing the over-center apparatus from the right-hand position of FIG. 5 to the left-hand position of FIG. 6, thus automatically disengaging the tooth 58 from the threads of the adjusting screw 30 upon reaching the litter position.

The foot rest structure as shown in FIGS. 5–7 and described above, also has the advantage that it permits ratcheting from lower positions to higher adjusted positions. That is, imagining that the user has adjusted the right-hand foot rest to the relatively low position shown in FIG. 1, and it should now be necessary or desirable to adjust that right-hand leg rest to a higher position such as that shown by the left-hand leg rest, the over-center to the right arrangement shown in FIG. 5 will permit such ratcheting, the spring 54 taking up the slight amount of motion of the pawl caused by the tooth 58 passing over each individual screw thread. The parts are configured so that the height of the thread is insufficient to throw over the over-center arrangement, the motion caused by going over the thread is merely absorbed by the spring. The height of the nut, however, is sufficient to "kick" the over-center apparatus over to the left, as shown in FIG. 7.

Thus, the leg rests can be set to an adjusted position using the manual handle 46, and higher adjusted positions can be automatically set by simply lifting the foot rests without having to further manually adjust anything. However, lower adjusted positions will require the operator to release the handle. The operator can take advantage of the ratcheting arrangement even in this situation, by simply lowering the foot rests to the bottom, re-engaging it at the bottom, and then ratcheting it up one or two or three threads at a time until the patient is comfortable.

Another advantage is provided by the nut 32 which operates the pawl 42. By simply moving the nut along the threads, the parts are configured to the proper operation, and causing the foot rests to arrive at the proper horizontal litter position.

The diameter of the pin 50 with respect to the opening in the bracket 48 is such as to create an imaginary point or line of pivot of the pin 50 in the bracket 48, and this line is perpendicular to and coincident with the line 45, the imaginary over-center line of the mechanism of the pin 50 and the pawl 42. That is, the center line of the pin 50 and the imaginary over-center line 45 are coincident at that point in the travel of the mechanism which corresponds to the "on center" position of the over-center device. In use, of course, the center line of the pin 50 will always be to the right as shown in FIG. 5 or else in the other unlocked position to the left as shown in FIG. 7 with respect to the imaginary center line 45.

Means are provided to control the motion of the invention wheelchair/litter between the chair position of FIG. 1 and the litter position of FIG. 4, and to also control the operation of the foot rest lift bar 26 in the manner described above.

Figure 8:
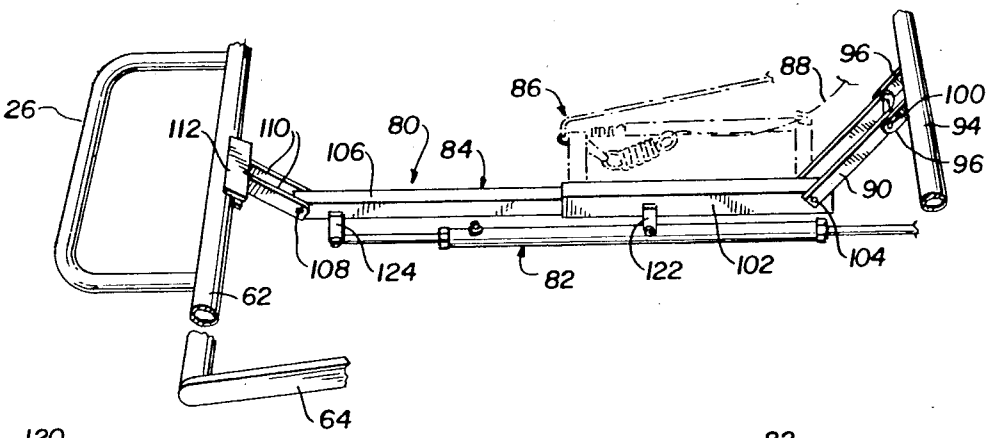
FIG. 8 is a perspective view of part of the chair of FIGS. 1–4 showing the cushioning cylinder, this view being taken looking downwardly from above the seat.

To this end, referring to FIGS. 1–4 and 8 and especially FIGS. 1 and 8, an intermediate bar 62 is provided. The foot rest lift bar which is of "U" configuration has its ends joined as by welding to the center portion of this intermediate bar 62. At its outer ends, one of which is shown in FIG. 8, there is provided a pair of extension bars 64 which extend upwardly from the intermediate bar 62 and which, join to arm rest bars 66 at pivot points 68. Intermediate its ends, the extension bar 64 carries a pivot link member 70 rigidly fixed thereto, the outer end of which is pivoted as at 72 to the top forward corner of the main framework 12.

The rear ends of the two arm rest bars 66 are pivoted to the back rest frame 14 as at 74. Each arm rest bar 66 carries a pair of vertical guide bars 76 which are guided by means not shown for vertical motion with respect to the main framework 12 in order to assure that the arm rests remain essentially horizontal during motion, as seen from the set of "action" drawings FIG. 1–4. These elements 76 have been eliminated in FIGS. 2, 3, and 4 for clarity.

The back rest frame 14 carries a pair of brackets 78 which are fitted to pivot points 16 at the upper rear corner of the main framework 12.

Thus, it can be seen that the entire mechanism pivots at the points 16 and 72, provided on the left and right sides, on the main framework 12. The linkage also includes the arm rest bars 66 and seat bars 18 which make up the horizontal parts of the linkage. At their rear ends, these bars are pivoted at 74 and 20 respectively both to the back rest frame 14. At their front ends, the linkage includes the extension bar 64 pivoted at its upper end at 68 to the arm rest bar 66, and to its lower end to the intermediate bar 62. Intermediate bar 62 supports the front end of the seat bars 18, the bars 18 simply resting on bar 62.

Means are provided to control the motion of this linkage between the litter and chair positions in a certain manner, and to also provide means to cushion the motion and help take up the weight when moving from the litter position of FIG. 4 down to the chair position of FIG. 1, while at the same time having no effect on the motion in the opposite direction from chair to litter so as to not unduly further burden the operator.

To this end, there is provided an assembly 80 comprising a cushioning cylinder 82 and a guide cylinder 84. The guide cylinder 84 is made of a pair of nested tubes of square or rectangular cross section and are relatively heavy and durable as they include means to lock the mechanism in the various adjusted positions shown in FIGS. 2, 3, and 4, as well as to serve as part of the linkage to take up the weight of the patient and of the mechanism itself. The locking assembly 86 is shown in phantom lines as it does not form a material part of the present invention. It includes a control cable 88 which leads up to a trigger or release bar 90 pivoted to the upper end of the back rest frame 14 in a closely spaced convenient position to a push bar 92.

Thus, as is clear, an attendant can manipulate the invention device when in the chair configuration by handling the push bar 92, while at the same time his hands are conveniently located with respect to the trigger 90 to change the adjusted position of the invention wheelchair/litter.

Referring to FIGS. 1 and 8, a bar 94 is rigidly attached to the two main side frames 12 and extends therebetween, perpendicular to the paper as seen in FIG. 1. Bar 94 carries a pair of relatively short bars 96 to which another pair of bars 98 are pivoted as at 100. The rear end of the housing portion 102 of the guide cylinder 84 is pivoted to the lower end of the bars 98 at pivots 104. The guide cylinder 84 also includes a moving portion 106 nested within the housing portion 102, and the outer free end of the moving portion 106 is pivoted as at 108 to a yoke 110 which is rigidly fixed by way of a bracket 112 to the intermediate bar 62. The moving part 106 simply slides within the housing part 102, no hydraulic or other working fluid being provided therebetween.

The cushioning function is provided by the cushioning cylinder 82 which comprises a cylinder housing 114 and a guide rod 116. Packing means 118 are provided at both ends of the cylinder housing 114 to seal the working fluid therein. A fill tube 120 is provided to "top up" the oil or air used as the working fluid in the cushioning cylinder 82. The rod 116 is considerably longer than the housing 114; at the minimum, by an amount equal to the throw or travel of this cylinder in moving from the seat position of FIG. 1 to the litter position of FIG. 4. The cushioning cylinder 82 is functionally joined to the linkage by way of bracket 122 which joins the stationary housing 102 of the guide cylinder 84 to the stationary housing 114 of the cushioning cylinder 82. In a similar manner, a bracket 124 is fixed as by an opening 126 to the forward end of the rod 116 and to the moving guide cylinder 106 of the guide cylinder assembly 84.

A piston 128 is provided inside the housing 114 in closely spaced position to the housing and to the rod 116 for motion with respect to both elements 114 and 116. A spring 130 urges the piston 128 to the left against a stop pin 132. Another stop pin 134 constrains the spring 130 between the piston 128 and itself. The rod 116 is formed with a cut-out 136, and the piston 128 moves with respect to this cut-out 136 between the positions of FIGS. 9 and 10 and adjusted positions therebetween.

While the drawings in FIG. 8 and the description herein describe the housing 114 of the cushioning cylinder 82 as being fixed while the rod is moved in conjunction with the motion of the linkage, the opposite arrangement of parts is also possible. That is, the rod end could be fixed to a non-moving part of the invention wheelchair/litter, while the cylinder housing 114 could be arranged to be the moving part. Such a rearrangement of parts might be desirable in some other embodiment of the present invention.

Figure 9:
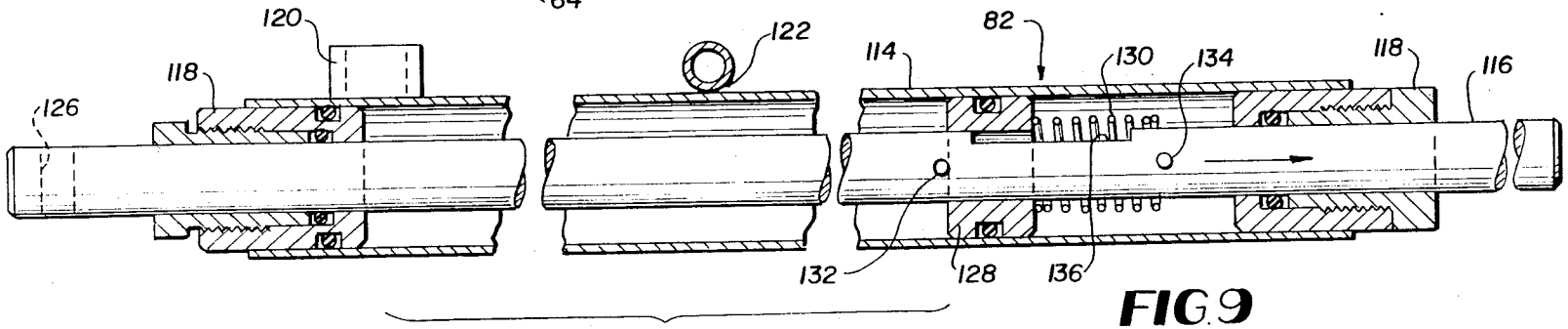
FIG. 9 is a longitudinal cross-sectional view partly broken away from the cushioning cylinder.

As to the operation of this part of the invention, the arrow on the rod 16 in FIG. 9 indicates motion to the right which corresponds to lowering from litter to chair. In this motion it is necessary to cushion the action of the linkage in order to gently lower the patient. The weight of the patient, together with the weight of the mechanism itself, when lowering to the chair position from the litter position absent the cushioning provided by the cylinder 82, is sufficient to upset the patient, to hove him violently, and in fact to even literally throw the patient out of the mechanism.

Referring to FIGS. 9 and 10 with this background, it can be seen that when moving to this lowered position, to the right as shown in FIG. 9, then the spring 130 urges the piston against the stop 132, thus effectively trapping the working fluid between the piston 128 and the right hand packing 118. This has a cushioning effect as the working fluid leaks very slowly between the relatively tight fit between the left hand side of the piston 128 and the part of the rod 116 between the stop 132 and the cut-out 136, that is the part of the rod which is not cut out. When moving in the opposite direction as indicated by the arrow on rod 116 in FIG. 10, then the piston motion to the right as urged by the trapped working fluid to the left of the piston 128 is sufficient to push the piston against the spring 130, to push it to its fully compressed length, which completely opens up the cut-out or fluid bypass 136. Thus, there is no cushioning or dampening effect at all, the working fluid is free to pass what amounts to through the piston 128 via the cut-out 136 to provide no such dampening.

In FIGS. 11 to 18, the removable upholstery features and their several variations are shown. Many parts have been omitted from these drawings, especially from the linkage, for the sake of clarity, and since such parts are not necessary for understanding these features.

Figure 13:
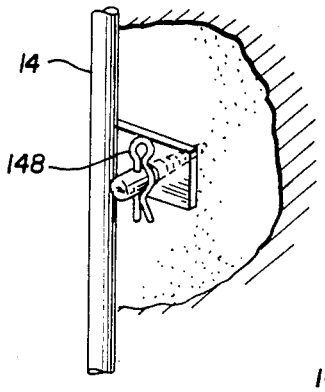
FIG. 13 a view of a detail of FIG. 11.

The back rest 138 itself includes a pair of pins 140 at the upper corners thereof and a pair of hanger brackets 142 at the lower end thereof. The back rest frame 144 over which the fingers 142 can be easily fit, the fitting motion being shown in FIG. 11. At its upper end, just below the upper-most corners and closely adjacent thereto, the frame 14 carries a pair of tabs 146 which cooperate with the pins 140, and can be locked therein as shown in FIG. 13 by cotter pins 148.

Figure 12:
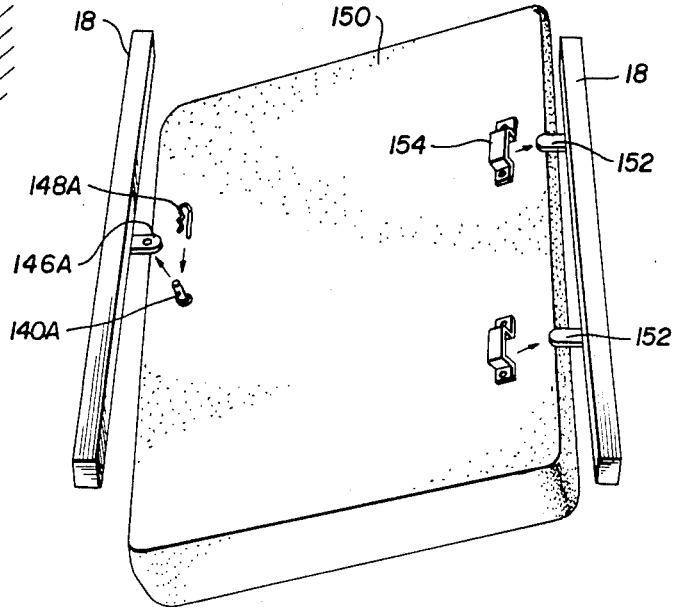
FIG. 12 is an exploded perspective view similar to FIG. 10 showing mounting of the seat.

The manner in which the seat member 150 is mounted to the seat bars 118 of the framework is shown in FIG. 12. This view is upside down, i.e., one could imagine oneself as lying on the floor looking up to the operator mounting the seat into the framework. The seat carries a pin 140A which cooperates with a tab 146A on one of the seat bars 18, and the companion seat bar carries a pair of tabs 152 which fit into "U"-shaped brackets 154. The pin 140A and brackets 154 are, of course, on the underside of the seat 150.

The manner in which the seat and back both quick mount and dismount from the respective frameworks 14 and 18 should now be evident. In the case of the back, the fingers 142 are slipped over the bar 144, and the seat brought forward to insert the pins 140 through the tabs 146 to be locked in place by the cotter pins 148. In a similar manner, working from above, the brackets 154 are slipped over the tabs 152, the pin 140A lowered into the tab 146A, and the cotter pin 148 inserted to secure the assemblage.

This structure provides numerous advantages over the prior art, including rapid cleaning, and permitting the use of slip covers, such slip covers not being shown as they are per se well known, i.e, analogous to fitted bed sheets, the slip covers can have elastic edges that fit over and around the respective back rest 138 and seat 150.

Figure 14:
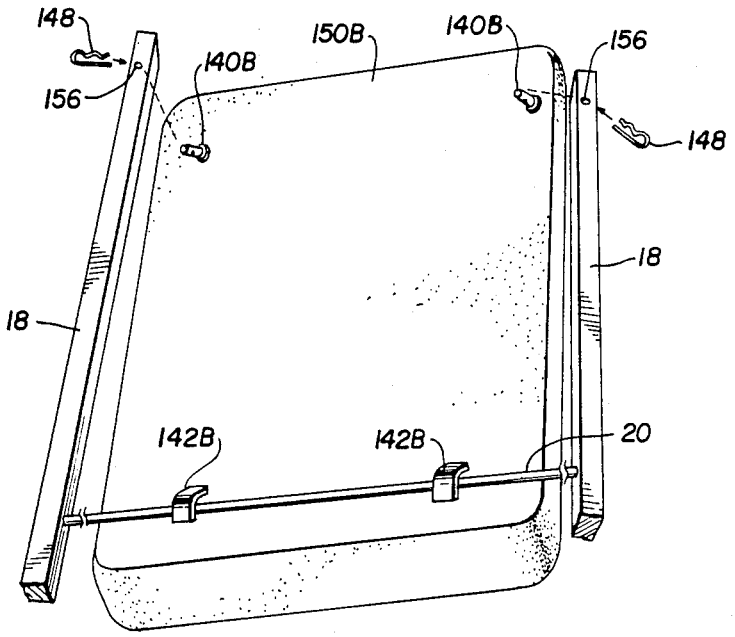
FIG. 14 is a view similar to FIG. 12 showing a variation of the seat mounting structure.

Referring to FIG. 14, there is shown another variation wherein the quick-release concept used for the back rest can be adapted for use with the seat cushion. Parts similar to or the same as those shown in earlier Figures and described above are indicated by the same reference numerals followed by "B".

Seat frame members 18 are formed with holes 156 which receive pins 140B on the seat 150, and fingers 142B fit over pivot bar 20 (see also FIG. 2). Cotter pins 148 secure the assemblage. The operation is analogous to that described above for the back seat and as shown in FIG. 11.

In FIGS. 15 and 16 the tabs, slots, pins, and the like which provide the removability feature for the invention seating are omitted for the sake of clarity. However, it will be understood that these parts will be present in the toilet seat embodiment of FIGS. 15–18 just as they are present in the other removable upholstery embodiments shown in FIGS. 11–14 and described above.

Referring now in detail to the drawings, a seat member 160 is provided formed with an opening 162 therein suitable for the toilet purpose for which this embodiment is intended. A pair of rail members 164 are provided front and rear of the opening 162 so that the catch bucket 168 can be placed or removed sideways with respect to the apparatus in an out of the rails 164 for use, emptying and cleaning. The seat member 160 may be formed of wood, plastic, it may be upholstered, or it may be formed of any other suitable material. In order to cover the opening 162 when not in use, in FIG. 16 there is shown a cushion member 166 which may fit loosely over the seat 160 to cover the hole 162. The user simply can lift himself or herself up slightly, remove the relatively thin hole covering cushion 166, and then use the opening 162 for its toilet purpose.

The details of the catch bucket or basin 168 are shown in FIGS. 17 and 18. This device includes an annular lip 170 which cooperates with the rails 164 to permit sliding of the catch basin 168 into and out of position under the hole 162. The bucket 168 is preferably formed of a suitable plastic material for light weight and ease of cleaning.

Optionally, the toilet seat 160 of FIGS. 15–18 can be mounted to and removed from the invention seating equipment in the same manner as the upholstered seat shown in the preceding drawings and described herein.

The removable upholstery feature of the invention is not limited to use on convertible equipment, but can be used on seating equipment in general, such as regular wheelchairs and geriatric chairs; and even outside the health care environment such as in aircraft and on other vehicles and on conventional furniture, for both business and home use.

Thus, as can be seen from the above, it is a relatively simple matter to remove or replace one or both of the back rest cushions or the toilet seat or seat cushion without the use of any tools whatsoever, in all of the FIGS. 11–18 embodiments of the invention.

The cotter pins 148 constitute manual locking means to hold the cushions in place. Likewise, the fingers 142 and the brackets 154 are functionally quick release holding means to hold the back rest and the seats, respectively, in their respective places on the seating equipment.

The remaining parts of the upholstery as shown in FIG. 1 on the arm rests and on the foot rests can be permanent or removable, and, in any case, are easily cleaned, if needed, after the seat and back rest are removed using the invention's advantageous quick release features described above.

While the invention has been described in detail above, it is to be understood that this detailed description is by way of example only, and the protection granted is to be limited only within the spirit of the invention and the scope of the following claims.

I claim:

1. In seating equipment, the combination comprising upholstered cushion means and toilet seat means, said upholstered cushion means including a seat cushion, and said seat cushion and said toilet seat means being optionally usable alternately as needed on said seating equipment, said seating equipment also comprising means to permit rapid assembly and disassembly of either said seat cushion or said toilet seat means from said seating equipment without the use of tools, said seating equipment comprising frame portions cooperable with both said seat cushion and said toilet seat alternatively, and said means to permit rapid assembly and disassembly comprising cooperating means between said seat cushion and said toilet seat means and said frame portions, said cooperating means comprising pin means on said upholstered cushion and said toilet means and tab means formed with openings adapted to receive said pin means, means to mount said tab means on said cooperating frame portions, and manually removable locking means to removably secure said pin means in said openings and said tab means, whereby said assembly and disassembly means comprises quick release holding means between said upholstered cushion and said toilet seats means and said cooperating frame portions.

2. In seating equipment, the combination comprising upholstered cushion means and toilet seat means, said upholstered cushion means including a seat cushion, and said seat cushion and said toilet seat means being optionally usable alternately as needed on said seating equipment, said seating equipment also comprising means to permit rapid assembly and disassembly of either said toilet seat or said cushioned seat from said seating equipment without the use of tools, said seating equipment comprising frame portions cooperable with both said cushion seat and said toilet seat alternatively, and said means to permit rapid assembly and disassembly comprising cooperating means between said toilet seat and cushion seat and said frame portions, said assembly and disassembly cooperating means comprising pin means and finger means on said seat cushion and said toilet seat means, said seating equipment comprising frame portions including a bar member cooperable with said finger means, said frame portions being formed with openings, said pin means being receivable in said openings, manually removable locking means to removably secure said pin means in said frame portions openings, and said pin means and said finger means being positioned on said seat cushion and said toilet seat means on opposite sides of the rear surface thereof.

3. The combination of claim 1, said assembly and disassembly means comprising bracket means fixed to the underside of said seat cushion and said toilet seat means and tab means fixed to the seat portion of said frame portions, said tab means being adapted to slide into and out of said bracket means, and said pin means comprising a single pin fixed to the underside of said seat cushion and said toilet seat means opposite said bracket means.

4. The combination of claim 1, said upholstered cushion means comprising a back rest, said assembly and disassembly means comprising finger means fixed to said back rest in closely spaced relation to the lower end thereof and a bar member fixed to the back portion of said frame portions, said finger means being adapted to fit over said bar member, and said pin means being fixed to said back rest in closely spaced relation to the upper end thereof.

5. The combination of claim 1, said seating equipment comprising a convertible wheelchair/litter.

6. The combination of claim 1, said seating equipment comprising a geriatric chair.

7. The combination of claim 1, said seating equipment comprising a conventional wheelchair.

8. The combination of claim 1, said toilet seat means cooperating means being located at the front and rear portions thereof; said toilet seat means comprising catch bucket means and comprising a seat formed with a toilet opening, rail means for removably locating said catch bucket means under said opening, and said rail means permitting mounting and dismounting of said catch bucket to and from said toilet seat sideways without interference from said cooperating means.

9. The combination of claim 1, said toilet seat means comprising a toilet opening formed therein, catch bucket means, and means to removably mount said catch bucket means below said opening, and said toilet seat means further comprising removable cushion means which can be mounted over said toilet seat opening.

* * * * *